US008869806B2

(12) United States Patent
Eccher

(10) Patent No.: US 8,869,806 B2
(45) Date of Patent: Oct. 28, 2014

(54) NAIL PROTECTION METHODS AND DEVICES

(76) Inventor: Denise Cecile Eccher, Pebble Beach, CA (US)

( * ) Notice: Subject to any disclaimer, the term of this patent is extended or adjusted under 35 U.S.C. 154(b) by 527 days.

(21) Appl. No.: 13/179,650

(22) Filed: Jul. 11, 2011

(65) Prior Publication Data

US 2013/0014305 A1 Jan. 17, 2013

(51) Int. Cl.

| | |
|---|---|
| ***A45D 24/00*** | (2006.01) |
| ***A45D 29/00*** | (2006.01) |
| ***A41D 13/08*** | (2006.01) |
| ***A41D 19/00*** | (2006.01) |
| ***A41B 11/00*** | (2006.01) |
| ***A43B 17/00*** | (2006.01) |
| ***A45D 44/00*** | (2006.01) |

(52) U.S. Cl.

CPC ..... *A41D 13/087* (2013.01); *A45D 29/00* (2013.01); *A45D 44/00* (2013.01)

USPC ..... 132/200; 132/73; 132/285; 2/16; 2/163; 2/239; 2/21

(58) Field of Classification Search

CPC ..... A45D 29/00; A45D 29/22; A45D 44/00; A41D 13/08; A41D 13/087; A41D 13/081; A41D 19/00; A41D 19/002; A61F 13/10; A61F 13/104; A61F 13/105; A61F 13/06; A61F 13/068; A61F 13/064

USPC ..... 132/285, 200, 73, 319, 320, 333, 75, 132/73.5; 2/163, 167, 161.3, 160, 159, 2/161.1, 21, 169, 16, 907, 158, 61, 239; 602/22, 30, 31; 223/101; D28/56, 57; D2/616, 617, 623, 991; 36/8.3, 10, 36/77 R, 96; 66/187, 178 R

See application file for complete search history.

(56) References Cited

U.S. PATENT DOCUMENTS

| | | | | | |
|---|---|---|---|---|---|
| 1,642,311 | A | * | 9/1927 | Richardson | 56/328.1 |
| 3,229,690 | A | * | 1/1966 | Scholl | 128/894 |
| 4,034,853 | A | * | 7/1977 | Smith | 206/278 |
| 4,454,624 | A | * | 6/1984 | Vandermer | 15/229.13 |
| 4,643,791 | A | * | 2/1987 | Jurrius et al. | 156/251 |
| 4,665,934 | A | * | 5/1987 | Jefferson | 132/320 |
| 4,677,697 | A | * | 7/1987 | Hayes | 2/159 |
| 4,694,843 | A | * | 9/1987 | Casenhiser | 132/73 |
| 4,751,747 | A | * | 6/1988 | Banks et al. | 2/21 |
| 4,858,245 | A | * | 8/1989 | Sullivan et al. | 2/21 |
| 4,908,881 | A | * | 3/1990 | Field | 2/21 |
| 5,127,127 | A | * | 7/1992 | Jarosinski | 15/227 |
| 5,415,184 | A | * | 5/1995 | Peck | 128/880 |
| D368,330 | S | * | 3/1996 | Robinson | D29/119 |

(Continued)

*Primary Examiner* — Vanitha Elgart
(74) *Attorney, Agent, or Firm* — Stephen E. Zweig

(57) ABSTRACT

A device and method for protecting the nails on a hand or foot from discoloration during a skin tanning process. The device is a one-piece "nail glove" configured to only cover the distal ends of the fingers or toes, while leaving the rest of the hand or foot exposed for the skin tanning process. The glove, which may be produced in the form of a low-cost disposable unit, is made from one or more materials, preferably UV resistant, and in some embodiments also biodegradable. The glove will be applied to the tips of the fingers or toes prior to the skin tanning process, kept on during the skin tanning process, and then removed afterwards. Various low cost materials and methods of producing and dispensing the device are also taught.

19 Claims, 3 Drawing Sheets

(56) References Cited

U.S. PATENT DOCUMENTS

| | | | | | |
|---|---|---|---|---|---|
| 5,749,097 | A * | 5/1998 | Garrett-Roe | 2/21 |
| D404,844 | S * | 1/1999 | Namin | D29/121.2 |
| 5,963,985 | A * | 10/1999 | Behr et al. | 2/21 |
| 6,112,331 | A * | 9/2000 | Horn | 2/163 |
| 6,145,128 | A * | 11/2000 | Suzuki | 2/21 |
| 6,302,116 | B1 * | 10/2001 | Copeland | 132/73 |
| 6,536,444 | B1 * | 3/2003 | Chung | 132/200 |
| 6,550,065 | B1 * | 4/2003 | Meyers | 2/16 |
| 6,662,807 | B2 * | 12/2003 | Meinschewnk | 132/200 |
| 6,748,605 | B1 * | 6/2004 | Brinkmann | 2/161.6 |
| 6,941,954 | B1 * | 9/2005 | Belcher | 132/73 |
| 6,990,985 | B1 | 1/2006 | Allen | |
| 2001/0001883 | A1 * | 5/2001 | Wanzenried | 2/21 |
| 2001/0032654 | A1 * | 10/2001 | Coker et al. | 132/200 |
| 2007/0180597 | A1 * | 8/2007 | Rose-Lydon | 2/239 |
| 2007/0186949 | A1 * | 8/2007 | Boothe | 132/285 |
| 2010/0024088 | A1 * | 2/2010 | Griefer | 2/16 |
| 2010/0037362 | A1 * | 2/2010 | Green et al. | 2/161.1 |
| 2011/0283439 | A1 * | 11/2011 | Backhaus et al. | 2/159 |
| 2011/0284017 | A1 * | 11/2011 | Nakamura | 132/73 |
| 2012/0305019 | A1 * | 12/2012 | Barile | 132/200 |

* cited by examiner

NAIL PROTECTION METHODS AND DEVICES

BACKGROUND OF THE INVENTION

1. Field of the Invention

This invention is in the field of nail protection devices, particularly with regards to protecting fingernails and toenails from discoloration due to exposure to ultraviolet light, spray-on tans, and other discoloring conditions.

2. Description of the Related Art

In order to enhance attractiveness, fingernail and toenail treatments, such as manicures, are common. Here, in what is often a fairly expensive beauty salon process, fingernails are cleaned, precisely cut, polished, and then often painted and/or covered with a colored or clear finish.

Other treatments are also done in order to enhance attractiveness. For example, individuals may also desire to acquire skin tans, often through exposure to ultraviolet light in the form of exposure to the sun, or to artificial ultraviolet light from tanning booths and the like. Alternatively, individuals may instead opt for spray on tans as well.

Unfortunately, as has been noted by other workers, the processes that generate skin tans often result in an unwanted discoloration of manicured nails. For example, ultraviolet light can react adversely with various paints and enamels, resulting in discoloration. Alternatively spray-on tans can also build up on the surface of the nails, again resulting in discoloration.

As a result, previous workers have proposed various methods to protect the nails from discoloration. For example, Meinschwenk, in U.S. Pat. No. 6,662,807 taught the use of releasably attachable nail jackets that would cover the user's nails. Similarly Allen and Scheurn, in U.S. Pat. No. 6,990,985 taught a relatively complex cover for fingernails that would cover the distal end of the user's finger and would have a specific width to height ratio of about 2:1 to 5:1. '895 teaches that these covers can last for hundreds or thousands of uses.

This later device, subsequently marketed as "Nail savers", has been commercially offered for sale, and is presently available at list price of $15.80 per set of 11 (i.e. enough to protect the nails on two hands, with one extra unit in case of loss or damage).

Although such high-cost reusable devices may be adequate for home users, who may contemplate reusing the nail savers over and over again for up to hundreds of times, this device may be less acceptable for commercial beauty salons, tanning salons, and the like, which have to deal with a high volume of customers. These customers may object to the use of previously used devices, and or may tend to "walk off" or accidently damage or lose the proprietor's device, resulting in economic loss to the proprietor. Thus further advances in the art would be desirable.

BRIEF SUMMARY OF THE INVENTION

The invention is based, in part, upon the insight that what is needed for this field is a method of nail protection that utilizes an easier to produce and potentially lower cost type of nail protective device that, in at least some embodiments, would also be disposable. This device, which may often be made of UV resistant materials, or even more preferably UV resistant and biodegradable materials, would in some embodiments also be designed to be provided in bulk, often in the form of sheets, boxes, or rolls.

In one embodiment, the invention may be a method of protecting all of the fingernails on a hand from discoloration during a skin tanning process. This method would work by providing a one-piece "fingernail (or toenail) glove" device configured to cover all of the nails and distal finger or toe tips of a hand or foot at one time, but to leave the rest of the hand or foot exposed to the tanning process. This fingernail glove or toenail glove would ideally be made from one or more materials that at least partially protect the fingernails (or toenails) from discoloration during the tanning process. The method would generally involve applying this one-piece glove or "fingernail glove" to the finger and thumb tips of a hand or foot, thereby covering the fingernails or toenails. The method would also involve providing a tanning process, and after completion of the tanning process, removing the one-piece glove, thereby allowing the substantial majority of the hand or foot to be tanned, while protecting the fingernails or toenails of the hand or foot. Ideally this one-piece glove will not extend past the first segment (distal portion) on all fingers and thumb, or of the toes if worn as a toenail protector.

Nomenclature: Because it is awkward to keep constantly separately referring to fingernails and toenails, unless otherwise specified, the invention's one-piece glove and method should be construed to encompass at least two designs, one for the fingers and thumb of a hand, and an alternate design for the big toe and little toes of a foot. Thus when the discussion discusses fingernails, it should be understood that toenails are also contemplated and taught. Generally, for conciseness, although the fingers and fingernails will be used as specific examples, corresponding use for toes and toenails should also be understood. Further, when the glove is being designed and intended for wearing on the foot, the discussion regarding fingers should be construed as also referring to the "little toes" (long toe, third toe, fourth toe, and fifth toe), while discussion regarding thumbs should be construed as referring to the "big toe" (hallux).

It is further contemplated that the one-piece glove may be ambidextrous so that it can be configured by, for example turning it over, to fit on either a right hand or foot, or a left hand or foot. Alternatively the one-piece glove may exist in customized right and left sided designs. Different sizes of glove to fit different sizes of hand or foot are also contemplated.

DETAILED DESCRIPTION OF THE INVENTION

Figure 1A:
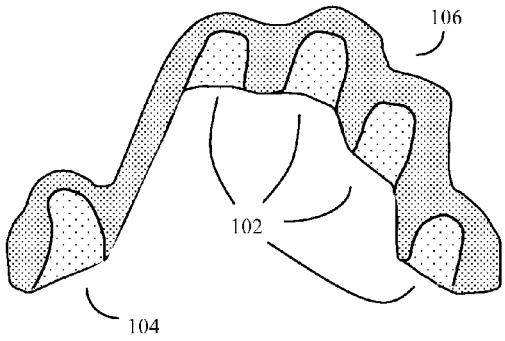
FIGS. 1A, 1B, and 1C show an overview of the one-piece fingernail glove. The glove is designed to cover both the top and bottom of all of the fingernails, and may in some embodiments be made from two pieces of material that are laminated or sewn together.

FIG. 1A shows an overview of the one-piece fingernail glove. The glove is designed to cover both the top and bottom of all of the fingernails, and may in some embodiments be made from two pieces of material that are laminated or sewn together. The glove will have pockets for at least the tips (distal portion) of the fingers and thumbs (102), (104) down to the base of the nail, and in some embodiments down to approximately the first joint, knuckle, or segment of the particular finger, thumb, or toe as the case may be. The regions between the pockets will be joined together by a continuous stretch of material (106) so that the glove is a continuous unit capable of covering all five nails of a particular hand or foot.

Figure 1B:
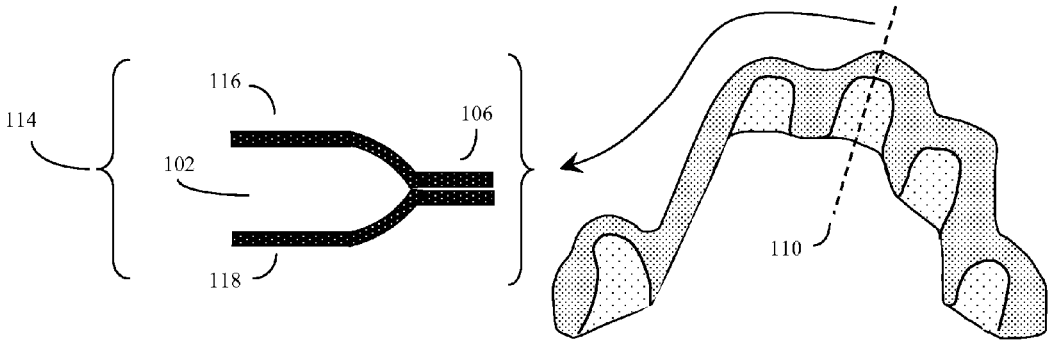

As will be discussed in more detail shortly, in some embodiments, the glove may be made by stitching, gluing, or laminating two layers of material together. To see this, a cross section (110) of glove (see FIG. 1B) is shown in (114). Here a top layer of material (116) is combined with a lower layer of material (118), forming a stitched together, glued together, laminated together or otherwise combined portion (106), as well as the pocket region(s) such as (102).

Figure 1C:
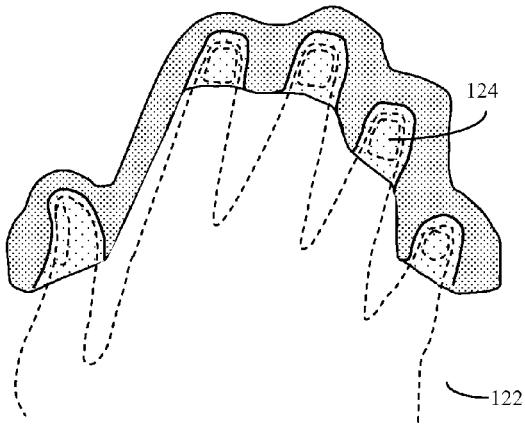

A drawing of the glove in use is shown in FIG. 1C. Here the user's hand (122) is placed in the pockets of the glove, and the glove's material shields the user's fingernails (124) from either exposure to ultraviolet light and/or spray tanning material. At the same time, the rest of the user's hand is exposed to the tanning process, thus avoiding inadvertently creating a "white untanned hand" effect.

Thus generally the user will put the one-piece fingernail glove (FIG. 1A) on the tips of the fingers covering the fingernails before a tanning session, go through the tanning process or session with the fingernail glove on, and then upon completion of the tanning process remove the one-piece fingernail glove. This protects the substantial majority of the user's hand (or foot), while protecting the nails from discoloration.

The glove may be held into position by various methods. In some methods, simply the contact friction between the sides of the glove and the tips of the user's fingers may be sufficient to hold the glove into place during a tanning session. Alternatively, use of adhesive tabs that help hold the gloves in place to various portions of the user's hand or fingers may also be used. Here, to avoid damaging the user's nails however, there generally will be no adhesive material placed over the portions of the glove that will be placed over the user's nails. In other methods, the glove may be made of a slightly elastic material so that the glove elastically expands slightly over the fingertips, thus providing additional pressure and friction to hold the glove in place.

Although the fingernail glove may be made from a durable material, such as fabric or non-woven fabric, that may be reused many times, in some embodiments, the glove may be a low cost disposable product.

The fingernail glove or device (FIG. 1A) may be made by a variety of different processes, including gluing or stitching woven or non-woven fabrics which are glued or stitched together to produce the one-piece glove. The glove may also be formed by a molding or dipping process, in which a liquid material (e.g. latex, plastic, or other material) is formed about a particular shape.

Figure 2:
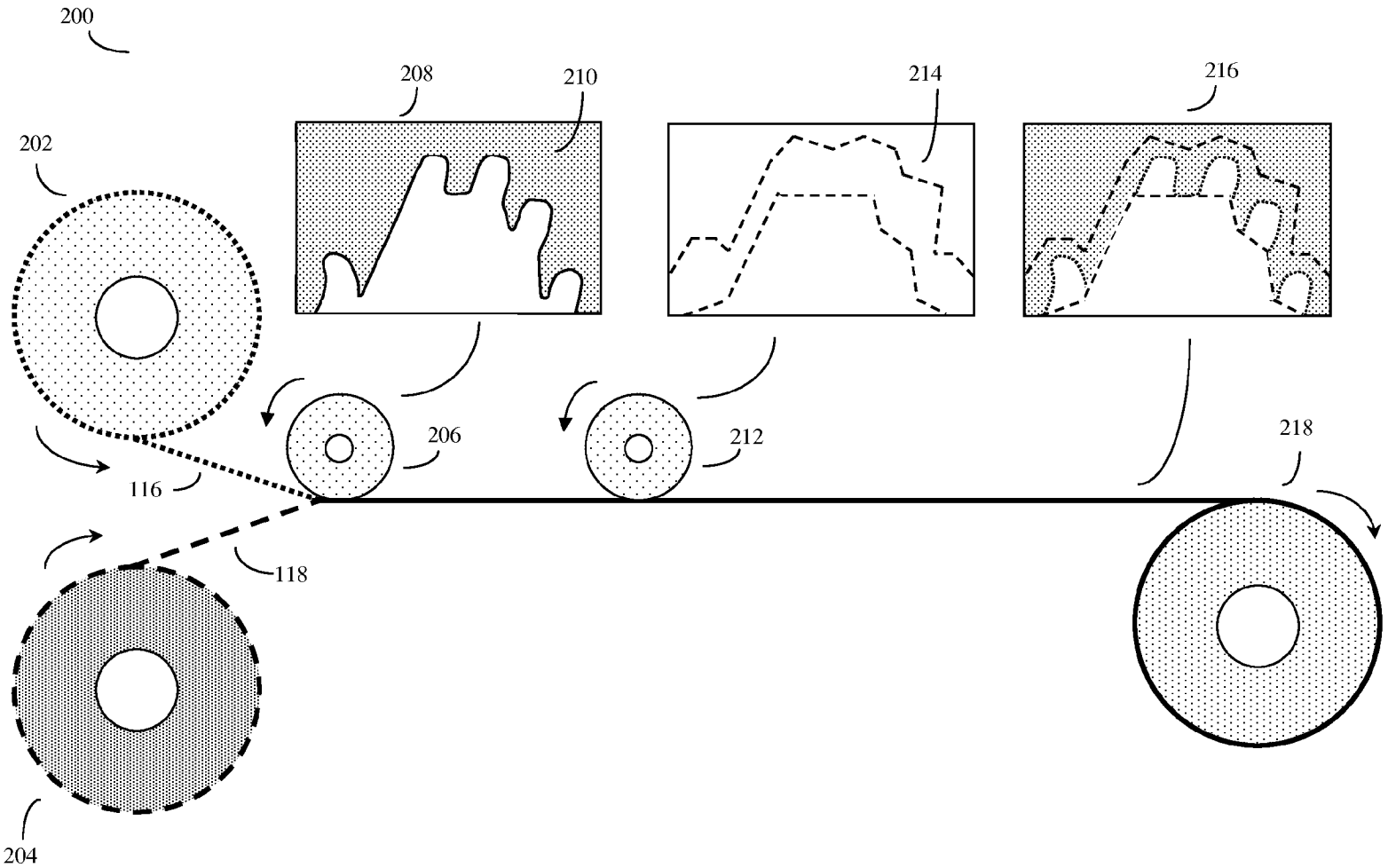
FIG. 2 shows an outline of one high-volume, low cost manufacturing method for the one-piece fingernail glove.

Alternatively the gloves may be formed by a web-based stamping and/or lamination process, such as is shown in FIG. 2 (200). In this example, a first roll (202) of a top material (116), and a second roll (204) of a bottom material (118) may be placed on a converting machine, such as a Mark Andy Narrow Web flexographic press, or other device, and processed into the individual gloves as a number of steps. For example, in a first process, a lamination press or cylinder (206) may laminate portions of the top (116) and bottom (118) material together by heat lamination, gluing, or other method. This will produce multiple repeating glove units corresponding to the pattern shown on (208), where the shaded areas (210) correspond to the regions where the top and bottom material are laminated together.

Next, a die press or rotary cylinder (212) can impress a series of perforations or cuts (214) along the same region of material previously laminated in (206) to (210). The final product (216) is the fingernail glove, which in some embodiments may be still partially attached to the original upper and lower material (116) (118) by the gaps between the perforations. These may be torn off by the user right before use. Alternatively instead of the cuts (214) being perforations, the cuts may have no gaps between the perforations, in which case the resulting glove (216) may be completely removed from the original upper and lower material and then packaged as desired.

This manufacturing method thus produces the glove in the form of a roll (218) or sheet comprised of a plurality of one-piece gloves, often plurality of one-piece gloves configured by perforations or other mechanism to be easily detachable from the roll or sheet without the need of additional tools (e.g., the gloves can be simply detached by the user by hand).

Generally sewing and use of fabric, or molded or dipped gloves will tend to be favored for multiple use fingernail gloves, while use of laminated non-woven fabrics, thin plastics, foils or composites will tend to be favored for disposable devices.

Generally, it will be advantageous to make the materials from a UV light absorbing material, which may be a woven fabric, non-woven fabric, plastic, foil and the like. In some embodiments of the invention, the plastics, fabrics, or non-woven fabrics used may be non-biodegradable. However in other embodiments of the invention, use of biodegradable material may be favored, because this way, users of the device will have no issues with wearing the device once and then throwing it away.

Examples of suitable biodegradable materials can include materials discussed in Gross and Kalra, "Biodegradable Polymers for the environment", Science 297, Aug. 2, 2002, pages 803-807. These materials include starch and cellulose derived plastics, polyhydroxylalkanoates (PHAs) and the like, and UV resistance may be enhanced through incorporation of titanium dioxide, carbon black, or various UV absorbing chemicals. Other biodegradable materials, such as those referenced in Stevens, "Green Plastics: An introduction to the New Science of Biodegradable Plastics", Princeton University Press, 2001 may also be used.

Examples of other suitable biodegradeable fibers and non-woven fabrics include the various composite fibers disclosed in, reviewed in or which reference Nakajima et. al., U.S. Pat. No. 6,045,908, the contents of which are incorporated herein by reference; and Miyahara et. al., U.S. Pat. No. 5,147,712, the contents of which are also incorporated by reference.

Figure 3:
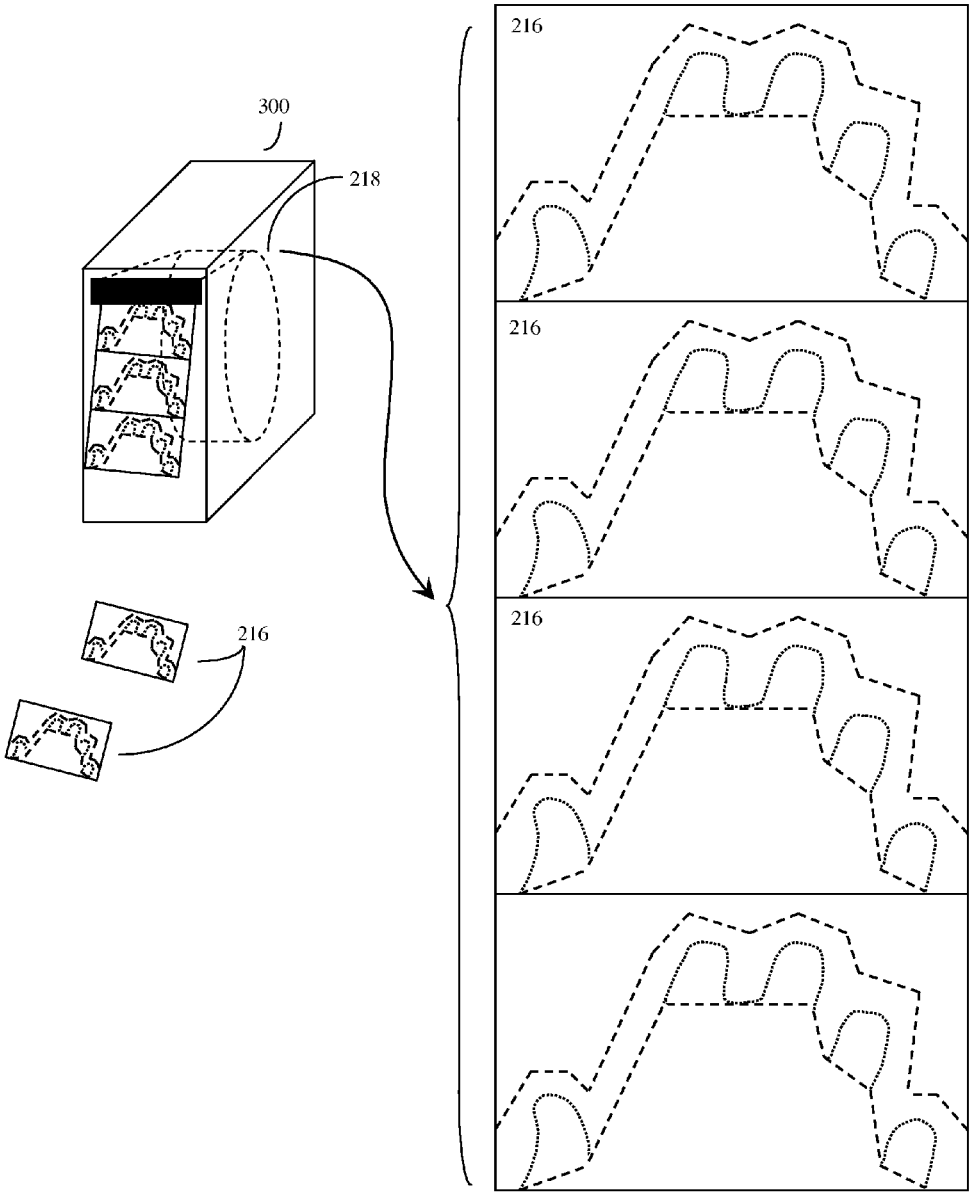
FIG. 3 shows an example of how an ambidextrous version of the one-piece fingernail glove may be produced in the form of a roll of disposable, tear-off, gloves which in turn may be placed in a dispensing box.

FIG. 3 shows an example of how an ambidextrous version of the one-piece glove may be produced in the form of a roll of disposable, tear-off, gloves (218) which in turn may be placed in a dispensing box (300).

In alternative version, the gloves could be present as sheets, and be dispensed from a box in individual or multiple sheet form, rather than roll form.

The invention claimed is:

1. A method of protecting all of the fingernails or toenails on a hand or foot from discoloration during a skin tanning process, said method comprising;

providing a one-piece glove;

said one-piece glove comprising pockets for said fingernails and finger and thumb tips of said hand, or pockets for said toenails and little toe and big toe tips of said foot, said pockets joined together by a continuous stretch of material between the pockets so that said one-piece glove is a continuous unit capable of covering all five fingernails or toenails of said hand or foot;

said pockets configured to only cover the fingernails and finger and thumb tips of said hand, or configured to only cover the toenails and little toe and big toe tips of said foot;

said continuous stretch of material further configured to allow the remainder of the hand or foot to be exposed to said skin tanning process;

said glove being made from one or more materials that at least partially protect said fingernails or toenails from discoloration during said tanning process;

applying said one-piece glove to the finger and thumb tips of said hand, or to the little toe and big toe tips of said foot, thereby covering said fingernails or toenails;

providing a tanning process;

and after completion of said tanning process, removing said one-piece glove, thereby allowing the substantial majority of said hand or foot to be tanned, while protecting the fingernails of said hand, or the toenails of said foot.

2. The method of claim 1, wherein said pockets of said one-piece glove do not extend past the first distal portion segment on all fingers and thumb or on all little toes and big toe.

3. The method of claim 1, wherein said pockets of said one-piece glove cover the tips of the fingers and thumb, or the tips of the little toe and big toe, but does not extend substantially past the base of the fingernails on said fingers and thumb, or the base of the toenails on said little toe and big toe.

4. The method of claim 1, wherein said materials comprise woven or non-woven fabrics which are glued or stitched together to produce said one-piece glove.

5. The method of claim 1, wherein said materials comprise plastic rolls, sheets or films, metalized foils, plastic-metal composite rolls, sheets or films which are laminated together to form said one-piece glove.

6. The method of claim 1, wherein said one-piece glove is formed by a molding or dipping process, and wherein said one-piece glove is further formed from a UV light absorbing material.

7. The method of claim 1, wherein said materials comprise a top layer of material that is glued or stitched or laminated together with a bottom layer of material, and wherein at least said top layer of material is a UV light absorbing material.

8. The method of claim 1, wherein said one-piece glove is disposable.

9. The method of claim 8, further providing said one-piece glove in the form of a roll or sheet comprised of a plurality of said one-piece gloves, said plurality of one-piece gloves configured by perforations or other mechanism to be easily detachable from said roll or sheet without the need of additional tools.

10. The method of claim 1, wherein said one-piece glove is reusable.

11. The method of claim 1, wherein said one-piece glove is made from biodegradable materials.

12. A one-piece glove device configured to cover all of the fingernails and thumbnail of a hand, or all of the little toe nails and big toe nail of a foot, while exposing at least the remainder of the hand past the first distal segment of the fingers and thumb of a hand, or exposing at least the remainder of the foot past the first distal segment of the little toes and the big toe of a foot;

said device further comprising pockets for said fingernails and finger and thumb tips of said hand, or pockets for said toenails and little toe and big toe tips of said foot, said pockets joined together by a continuous stretch of material between the pockets so that said one-piece glove is a continuous unit capable of covering all five fingernails or toenails of said hand or foot;

said pockets configured to only cover the fingernails and finger and thumb tips of said hand, or configured to only cover the toenails and little toe and big toe tips of said foot;

said continuous stretch of material further configured to allow the remainder of the hand or foot to be exposed to a skin tanning process; and wherein said pockets covers the tips of the fingers and thumb, or the tips of the little toe and big toe, but do not extend substantially past the base of the fingernails on said fingers and thumb, or substantially past the base of the toenails on said little toes and big toe.

13. The device of claim 12, wherein said device further comprises device materials, and wherein said device materials comprise plastic rolls, sheets or films, metalized foils, plastic-metal composite rolls, sheets or films which are laminated together to form said one-piece glove, or wherein said materials comprise woven or non-woven fabrics which are glued or stitched together to produce said device.

14. The device of claim 12, wherein said device is formed by a molding or dipping process, and wherein said one-piece glove is further formed from a UV light absorbing material.

15. The device of claim 12, wherein said device further comprises device materials, and wherein said device materials comprise at least one UV light absorbing material.

16. The device of claim 12, wherein said device is disposable.

17. The device of claim 16, further providing said device in the form of a roll or sheet comprised of a plurality of said devices, said plurality of devices configured by perforations or other mechanism to be easily detachable from said roll or sheet without the need of additional tools.

18. The device of claim 12, wherein said device is reusable.

19. The device of claim 12, wherein said device is made from biodegradable materials.

* * * * *